US005567131A

United States Patent [19]

McNaull

[11] Patent Number: 5,567,131

[45] Date of Patent: Oct. 22, 1996

[54] SPRING BIASED CHECK VALVE FOR AN ELECTROMAGNETICALLY DRIVEN OSCILLATING PUMP

[75] Inventor: Michael H. McNaull, Ashland, Ohio

[73] Assignee: Gorman-Rupp Industries, Bellville, Ohio

[21] Appl. No.: 425,288

[22] Filed: Apr. 20, 1995

[51] Int. Cl.[6] ..... F04B 17/04

[52] U.S. Cl. ..... 417/417; 417/554; 417/DIG. 1; 137/539

[58] Field of Search ..... 417/241, 417, 417/472, 554, DIG. 1; 137/539

[56] References Cited

U.S. PATENT DOCUMENTS

| | | | |
|---|---|---|---|
| 3,116,695 | 1/1964 | Faller | 417/241 |
| 3,136,257 | 6/1964 | Smith et al. | 417/241 |
| 3,567,176 | 3/1971 | Johnson . | |
| 3,768,509 | 10/1973 | Goda | 137/539 |
| 3,877,844 | 4/1975 | Klaus et al. . | |
| 4,195,666 | 4/1980 | Goetz et al. . | |
| 4,252,510 | 2/1981 | Bromley . | |
| 4,389,169 | 6/1983 | De Dionigi | 414/417 |
| 4,667,697 | 5/1987 | Crawford . | |
| 4,824,337 | 4/1989 | Lindner et al. | 417/417 |
| 4,827,968 | 5/1989 | Brown | 417/417 |
| 4,945,945 | 8/1990 | Schmid . | |
| 4,958,661 | 9/1990 | Holtermann . | |
| 5,090,447 | 2/1992 | Lewis et al. . | |
| 5,229,297 | 7/1993 | Schnipelsky et al. . | |
| 5,295,367 | 3/1994 | Keltner . | |
| 5,297,580 | 3/1994 | Thurman . | |

FOREIGN PATENT DOCUMENTS

| | | | |
|---|---|---|---|
| 288216 | 10/1988 | European Pat. Off. | 417/417 |
| 8375 | 1/1982 | Japan | 417/417 |

*Primary Examiner*—Timothy S. Thorpe
*Assistant Examiner*—Roland G. McAndrews, Jr.
*Attorney, Agent, or Firm*—Jones, Day, Reavis & Pogue

[57] ABSTRACT

A valve assembly is disclosed for an oscillating pump of the type having a reciprocating armature carrying an impeller that defines a pump chamber for flow of fluid through the pump. The valve assembly includes a valve body mounted to the impeller, a valve seat attached to the valve body, a spring retainer, a spring mounted to the spring retainer and a plug located between the spring and the valve seat. The valve assembly provides a substantially fluid tight seal when the pump is discharging fluid and allows fluid to enter the pump chamber when the pump is suctioning. All wetted components are particularly suitable for corrosive fluids, such as acids.

17 Claims, 4 Drawing Sheets

SPRING BIASED CHECK VALVE FOR AN ELECTROMAGNETICALLY DRIVEN OSCILLATING PUMP

TECHNICAL FIELD

This invention relates generally to pump valve assemblies. More particularly, this invention relates to valve assemblies that are suitable for use within an oscillating pump and even more particularly for pumping corrosive fluids such as acids.

DESCRIPTION OF THE RELATED ART

Oscillating pumps are known in the art. For example, U.S. Pat. No. 3,136,257 by E. M. Smith et al discloses the general structure and operation of an oscillating pump. Smith teaches the use of an elastomeric impeller having integral wings to move the fluid through the pump. U.S. Pat. No. 4,824,337 by Lindner et al generally teaches a valve assembly having valve leaves and a valve seat in place of the integral wings of the Smith patent in an attempt to provide longer and more consistent valve performance. However, this leaf valve assembly also may have a relatively short life due to the weakening, swelling, or stiffening of the elastomeric material caused by the corrosive fluids in which these valves sometimes operate. Furthermore, these leaves have a relatively low resistance to wear, a feature which is inherent to the elastomeric material and is amplified in normal pump operation by repeated engagement and disengagement of the valve leaves with the valve seat. Thus, there remains a need for an oscillating pump valve assembly that provides maintenance-free consistent operation over a long period of time and that is particularly suitable for use in corrosive fluids.

BRIEF SUMMARY OF INVENTION

The invention is summarized as a valve assembly for an oscillating pump of the type having a reciprocating armature that carries an impeller to which the valve assembly is also mounted. The impeller defines a pump chamber for the flow of fluid through the pump upon reciprocation of the armature and operation of the valve assembly. The valve assembly is comprised of a valve body, valve seat, spring, spring retainer, and plug, all of which are preferably made of materials suitable for use in corrosive fluids, such as acids.

DETAILED DESCRIPTION OF THE INVENTION

Figure 1:
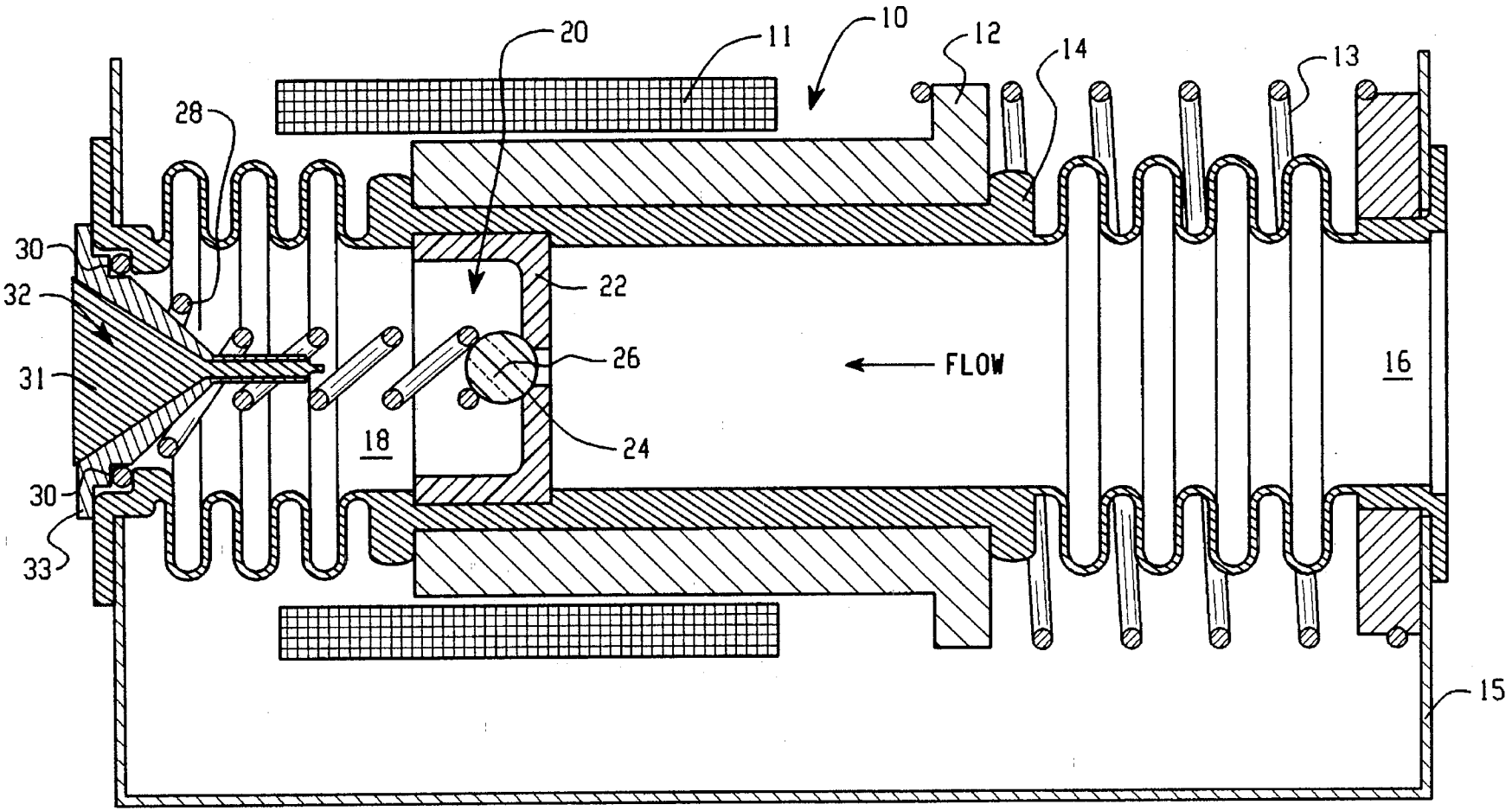
FIG. 1 is a longitudinal cross section of a portion of an oscillating pump depicting a valve seat assembly according to the invention.
Figure 3:
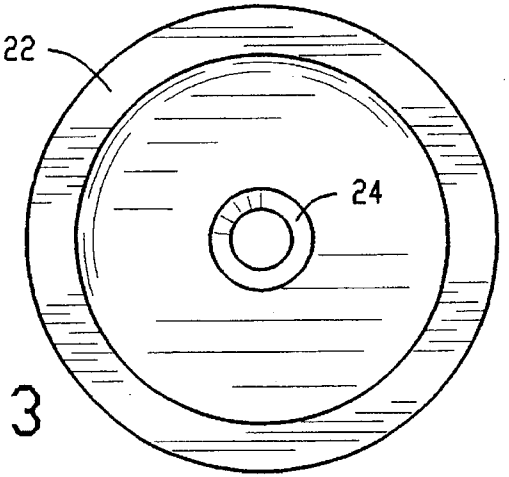
FIG. 3 is an end view detail of a valve body according to the invention.

A portion of an oscillating pump having a valve assembly according to the present invention is indicated generally by numeral 10 in the drawings. Referring now to FIG. 1, the typical electrically operated oscillating pump includes an electromagnetic coil 11, a metallic armature 12, and a generally cylindrical elastomeric impeller 14. The internal surface of the impeller defines a pumping chamber having an inlet end 16 and an outlet end 18.

A valve assembly according to the present invention is indicated generally by the numeral 20 and is located between inlet end 16 and outlet end 18 of the pump chamber. The valve assembly 20 includes a valve body 22, a valve seat on the valve body 24, a plug 26, a spring 28, and a spring retainer 30.

Figure 2:
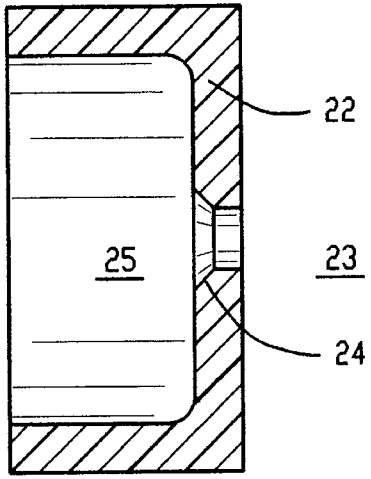
FIG. 2 is a side view detail of a valve body according to the invention.

The valve body 22 can be constructed of any rigid material suitable for corrosives, but the valve body 22 additionally must be capable of withstanding repeated engagement and disengagement of the plug 26 against the valve seat 24. Materials such as ferrous and non-ferrous metals, plastics, polymers, composites, plastic composites, polymer composites, and ceramics are all acceptable and known in the art, but polyphenylene sulfide by the tradename RYTON is used in the most preferred embodiment and represents the best overall balance of rigidity, wear resistance, corrosion resistance, and cost. The valve body 22 can be recessed into the internal surface of the impeller 14 as shown in FIG. 1 or attached by any other suitable means depending on the material used. Examples of other methods of attachment include but are not limited to adhering, gluing, bonding, pressing, fusing, casting and welding. Referring now to FIG. 2, which is a detail view of one valve body 22, an inlet side 23 and an outlet side 25 of the valve body 22 are identified. These sides correspond to the inlet end 16 and outlet end 18 of the pump chamber in their relative positions.

Also depicted in FIG. 1 and FIG. 2 is the valve seat 24, which in the most preferred embodiment as shown in FIGS. 1 and 2, has been formed of the same material (RYTON) and at the same time as the valve body 22. Alternatively, the valve seat 24 can be made of any of the same materials noted above for the valve body 22. Other methods for providing a valve seat 24, which depend upon the material selected, are also possible and include but are not limited to adhering, gluing, bonding, pressing, fusing, casting and welding the pre-selected material to the valve body 22.

Referring to FIG. 1, the plug 26 is sized to fit within the valve seat 24 and form a substantially fluid tight seal when engaged against the valve seat 24 under pressure exerted by the spring 28 or fluid forces when the pump is in its forward (discharge) stroke. As shown in the FIGURES, the most preferred embodiment is a ball, but it will be understood that this part may be in any shape that forms a plug 26 to the valve seat 24 and need not be a ball. While an absolute fluid tight seal is not required for the pump to operate, operation efficiency dramatically decreases with an increase in leakage. A substantially fluid tight seal is that level of seal that is required for the pump to operate effectively. The plug 26, like the valve body 22 and valve seat 24, should be constructed of materials suitable for corrosive fluids, which are noted above. Additionally, however, the plug 26 must be rigid enough to maintain its shape under constant stress due to the spring 28 and repeated engagement and disengagement of the valve seat 24. Of the possible materials listed above for the valve body 22 and valve seat 24, stainless steel, polypropylene, and quartz silica or glass are all preferred, but glass has been found to be most preferred as having the best overall balance of weight, rigidity, and resistance to corrosion, deformation, and wear.

The spring 28 can be made of many materials such as those listed above for the valve body 22, but the most preferred material has been found to be 316 stainless steel. The spring 28 should be selected such that the force exerted by the spring 28 upon the plug 26 allows the plug 26 to disengage the valve seat 24 upon the suction stroke of the armature 12 but form a substantially fluid tight seal between the plug 26 and the valve seat 24 upon the discharge stroke of the armature or when the pump is at rest. Moreover, in the preferred embodiment of the valve assembly 20 that is shown in FIG. 1, the spring's 28 length and diameter also perform the function of keeping the plug 26 disposed within the confines of the valve body 22 for ease of engagement with the valve seat 24.

Figure 4B:
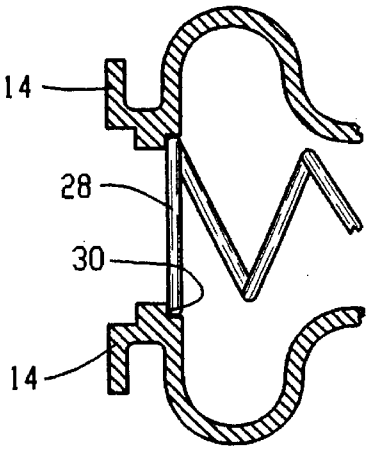
FIG. 4B is a side view detail of a portion of the outlet end of the pump chamber showing one method of providing a retainer for the spring.

The spring retainer 30 can be formed several ways, which include but are not limited to attaching the spring to the internal side of the impeller by grooving, adhering, gluing, bonding, pressing, grooving, welding, or notching. One example of forming spring retainer 30 is shown in FIG. 4B. The preferred method of providing a spring retainer, however, is by addition of an element mounted to the impeller 14. As shown in FIG. 1, this element is a check valve 32 mounted at the outlet end of the pump chamber 18.

Figure 4:
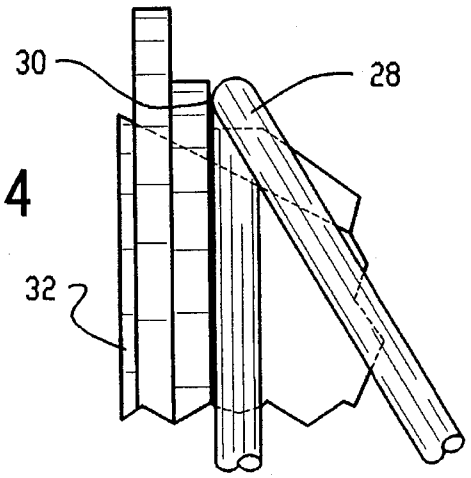
FIG. 4 is side view detail of a portion of the check valve showing one method of providing a retainer for the spring.

The check valve 32 preferred most by the inventor is of the type having a rigid conical frame 33 and an elastomeric conical flap 31. Fluid passes through holes in the frame 33 and around the edge of the flap 31 in one direction but cannot pass in the opposite direction because the fluid presses the flap 31 against the frame 33 thereby plugging the holes in the frame 33. Other elements, such as a flange or an orifice as well as others, could be added to provide the retainer 30 other than a check valve 32. The retainer 30 that has been found to be most preferred is shown in FIG. 4 as a lip formed as part of the exterior of the check valve 32 upon which the spring 28 rests.

Figure 5:
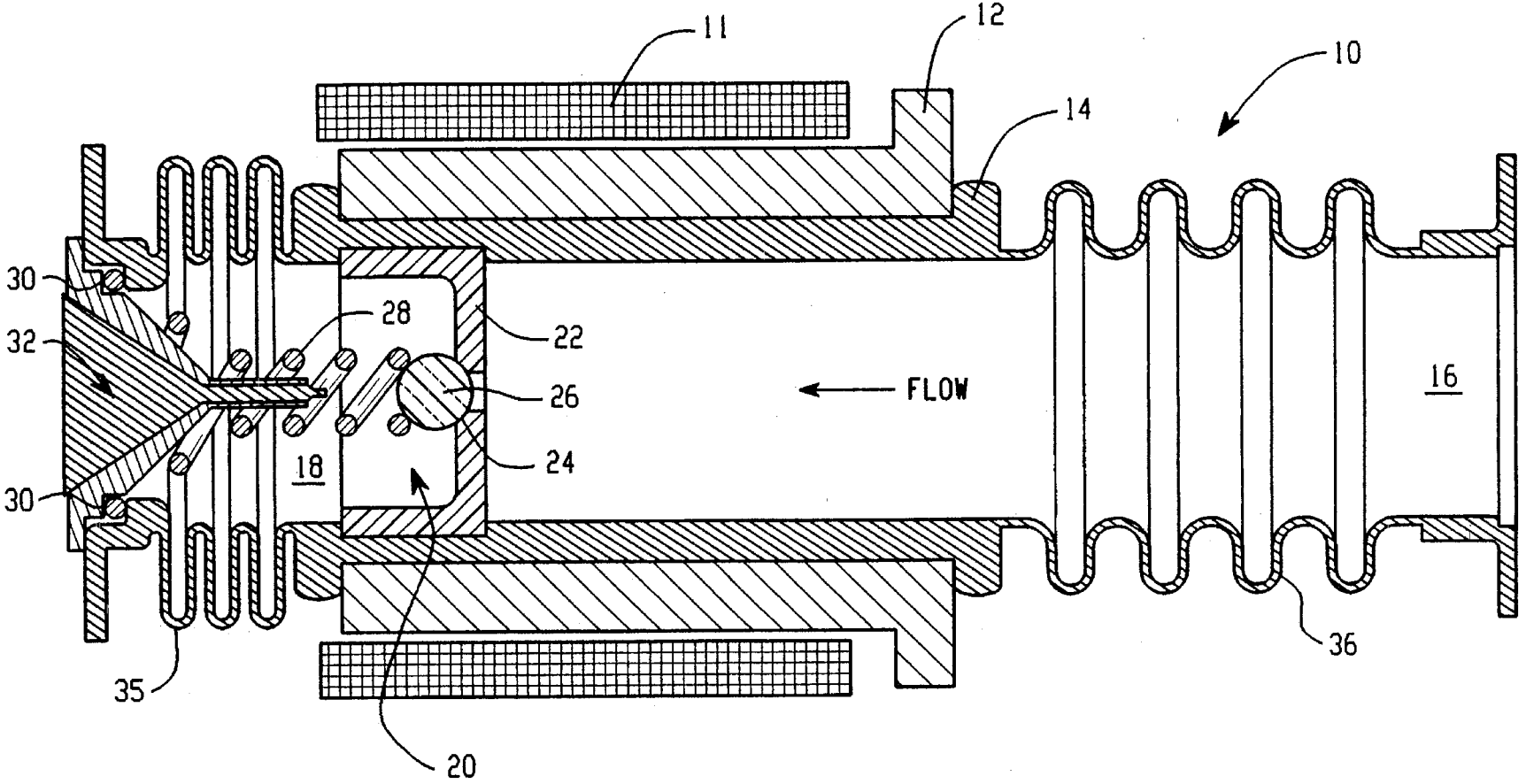
FIG. 5 is a longitudinal cross section similar to FIG. 1 showing the pump near the end of its forward (discharge) stroke.
Figure 6:
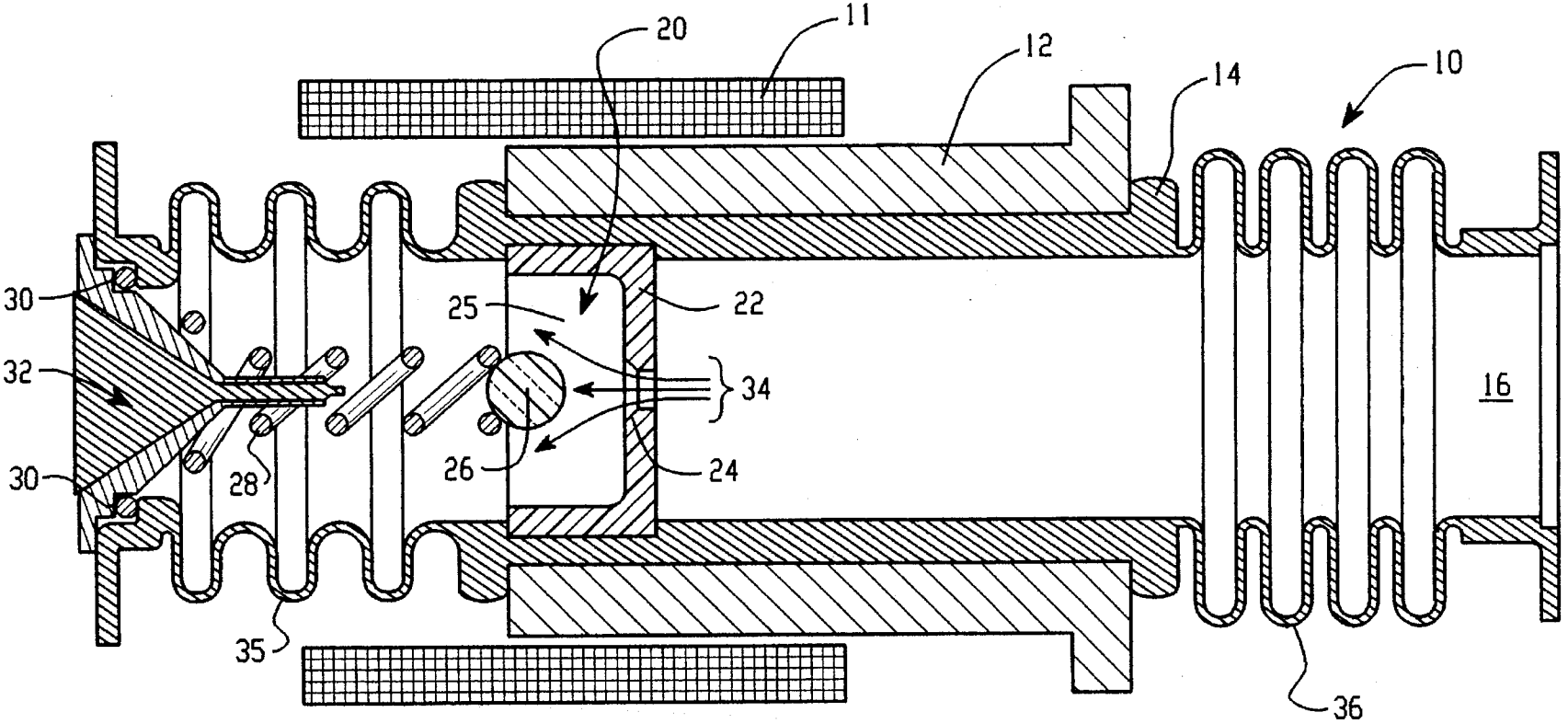
FIG. 6 is a longitudinal cross section similar to FIG. 1 showing the pump near the end of its reverse (suction) stroke.

The full sequence of operation of the pump and valve assembly is described using FIGS. 1, 5 and 6. FIG. 1 depicts a portion of an oscillating pump 10 in an at rest position. When the pump 10 is turned on, magnetic impulses generated by the electromagnetic coil 11 cause the metallic armature 12 to longitudinally reciprocate at a rate dependent upon electrical frequency, typically 60 Hz. This movement could also be provided by other armature configurations such as by mechanical linkage or other drive mechanisms. The forward stroke is the movement of the armature 12, which carries along with it the impeller 14, the valve body 22, the valve seat 24, and the plug 26 from that position shown in FIG. 1 to that position shown in FIG. 5.

During the forward stroke the spring 28 and the dynamic forces of the fluid in the pump chamber cause the plug 26 to engage the valve seat 24 and form a substantially fluid tight seal. Thus, as the impeller 14 moves forward, the fluid is forced out the outlet end 18 of the pump chamber and through the check valve 32 if it exists. During this stroke, the outlet end impeller ribs 35 and the spring 28 become compressed; the inlet end impeller ribs 36 expand. The forward stroke ends when the magnetic impulse ceases.

Upon cessation of the magnetic impulse, an external spring (not shown, but described in U.S. Pat. No. 3,136,257, which is incorporated herein by reference) retracts the armature 12 and its attached parts toward the at rest position shown in FIG. 1. This operation is depicted in FIG. 6. During this stroke, the outlet end impeller ribs 35 expand and the inlet end impeller ribs 36 compress.

Referring to FIG. 6, during at least a part of the reverse stroke of the pump 10, the external spring retracts the armature 12, impeller 14, valve body 22, and valve seat 24 at a faster rate than the spring 28 propels the plug 26 towards the valve seat 24. Thus, on this reverse stroke fluid is forced through the valve body 22 to its outlet side 25. Fluid entering the outlet side 25 is depicted as lines 34 in FIG. 6. Fluid enters the outlet side 25 until the pump 10 ceases the reverse stroke and equilibrium of forces is reached, at which time the spring 28 forces the plug 26 to engage the valve seat 24 and once again form a substantially fluid tight seal as shown in FIG. 1.

From the foregoing, it is evident that the need for an oscillating pump valve assembly that provides long life in corrosive fluids is met by the present invention. While the invention has been described for use in corrosive environments and as a singular unit, it is appreciated that the valve assembly could be used in other non-corrosive environments and in multiple configurations.

Furthermore, although the present invention has been described with some particularity, it is understood that this description is made by example and for understanding and that changes in details of the structure and materials may be made without departing from the concept of the invention.

What is claimed is:

1. A valve assembly for an oscillating pump of the type having a reciprocating armature carrying an elastomeric impeller that defines a pump chamber for the flow of fluid from an inlet end to an outlet end, the valve assembly comprising:

a valve body attached to the impeller for reciprocation within the pump chamber and having an inlet side that faces the inlet end of the pump chamber and an outlet side that faces the outlet end of the pump chamber;

a means for plugging the flow of fluid from the outlet side of the valve body to the inlet side of the valve body during a forward reciprocation of the impeller and passing fluid from the inlet side of the valve body to the outlet side of the valve body during a reverse reciprocation of the impeller.

2. The valve assembly of claim 1 wherein the means for plugging and passing fluid comprises a plug and a spring.

3. A valve assembly for an oscillating pump of the type having a reciprocating armature carrying an elastomeric impeller that defines a pump chamber for the flow of fluid from an inlet end to an outlet end, the valve assembly comprising:

a valve body attached to the impeller for reciprocation within the pump chamber and having an inlet side that faces the inlet end of the pump chamber and an outlet side that faces the outlet end of the pump chamber;

a valve seat integral with the outlet side of the valve body;

a plug disposed between the outlet side of the valve body and the outlet end of the pump chamber and adapted to engage the valve seat to form a substantially fluid tight seal when in a closed position and to disengage the valve seat and allow the flow of fluid through the pump chamber when in an open position;

a retainer adapted to seat a spring located between the plug and the outlet end of the pump chamber; and the spring disposed between the plug and the retainer and having a first end adapted to engage the plug and a second end adapted to engage the retainer.

4. The valve assembly of claim 3 where the impeller is provided with a second internal recess to form the retainer.

5. The valve assembly of claim 3 where the valve body and valve seat are constructed of polyphenylene sulfide.

6. The valve assembly of claim 5 where the plug is a glass ball.

7. The valve assembly of claim 3 where the impeller is provided with a first internal recess to receive and engage the valve body.

8. The valve assembly of claim 7 where the valve body and valve seat are made of polyphenylene sulfide and the plug is a glass ball.

9. The valve assembly of claim 7 where the impeller is provided with a second internal recess to form the retainer.

10. The valve assembly of claim 9 where the valve body and valve seat are made of polyphenylene sulfide and the plug is a glass ball.

11. An oscillating pump comprising:

an electromagnetic coil;

a metallic armature reciprocatable with respect to the electromagnetic coil;

an elastomeric impeller attached to the armature and defining a pump chamber for the flow of fluid from an inlet end to an outlet end of the pump chamber;

a valve body attached to the impeller for reciprocation within the pump chamber and having an inlet side that faces the inlet end of the pump chamber and an outlet side that faces the outlet end of the pump chamber;

a valve seat integral with the outlet side of the valve body;

a plug disposed between the outlet side of the valve body and the outlet end of the pump chamber and adapted to engage the valve seat to form a fluid tight seal when in a closed position and to disengage the valve seat and allow the flow of fluid through the pump chamber when in an open position;

a retainer adapted to seat a spring located between the plug and the outlet end of the pump chamber; and the spring disposed between the plug and the retainer and having a first end adapted to engage the plug and a second end adapted to engage the retainer.

12. An oscillating pump according to claim 11 where the valve body and the valve seat are made of polyphenylene sulfide and the plug is a glass ball.

13. An oscillating pump according to claim 11 where the impeller is provided with a first internal recess to receive and engage the valve body and a second internal recess to form the retainer.

14. An oscillating pump according to claim 11 including a check valve mounted within the pump chamber at the outlet end, the check valve having a retainer adapted to seat the spring.

15. An oscillating pump according to claim 14 where the valve body and the valve seat are made of polyphenylene sulfide and the plug is a glass ball.

16. An oscillating pump according to claim 14 where the impeller is provided with a first internal recess to receive and engage the valve body.

17. An oscillating pump according to claim 16 where the valve body and valve seat are made of polyphenylene sulfide and the plug is a glass ball.

* * * * *